US007140377B1

(12) United States Patent
Dahulich

(10) Patent No.: US 7,140,377 B1
(45) Date of Patent: Nov. 28, 2006

(54) TENT WITH INTERNAL SUPPORT

(75) Inventor: Wayne G. Dahulich, Castle Creek, NY (US)

(73) Assignee: Johnson Outdoors Inc., Racine, WI (US)

( * ) Notice: Subject to any disclaimer, the term of this patent is extended or adjusted under 35 U.S.C. 154(b) by 290 days.

(21) Appl. No.: 10/726,065

(22) Filed: Dec. 2, 2003

(51) Int. Cl.
*E04H 15/36* (2006.01)

(52) U.S. Cl. ..... 135/136; 135/97; 135/156; 135/119

(58) Field of Classification Search ..... 135/156, 135/119, 121, 122, 124, 128, 136, 909, 138, 135/115, 120.4, 906, 907, 908, 97; 52/270, 52/271; 403/24, 42, 179
See application file for complete search history.

(56) References Cited

U.S. PATENT DOCUMENTS 1,054,251 A * 2/1913 Stone ..... 135/121
1,560,114 A * 11/1925 Skog ..... 135/124
2,818,875 A * 1/1958 Denn ..... 135/909
3,088,244 A * 5/1963 Commisso ..... 135/124
3,092,175 A * 6/1963 Suessle ..... 135/119
3,171,417 A * 3/1965 Stokes ..... 135/132
3,240,217 A * 3/1966 Bird et al. ..... 135/123
4,442,626 A * 4/1984 Hammond ..... 135/119
5,335,685 A * 8/1994 Dahulich ..... 135/156
5,555,681 A * 9/1996 Cawthon ..... 135/119
5,595,204 A * 1/1997 Hwang ..... 135/156
6,618,988 B1 * 9/2003 Williams et al. ..... 135/122

* cited by examiner

*Primary Examiner*—Tamara L. Graysay
(74) *Attorney, Agent, or Firm*—Reinhart Boerner Van Deuren P.C.

(57) ABSTRACT

A internal support structure for a tent having a shell is disclosed. The internal support structure comprises at least one internal support structure configured to provide structural support to the shell, the internal support structure having a pair of gussets each having a member extending from the gussets. The members are configured to engage the shell and provide structural support to the shell. The internal support structure is disposed adjacent to the shell without occupying space in the middle portion of an internal space defined by the shell.

26 Claims, 7 Drawing Sheets

TENT WITH INTERNAL SUPPORT

FIELD

The present invention relates to a tent with internal support.

BACKGROUND

It is generally known to provide for a tent with internal support structures. Such known internal support structures for tents are typically located in the central portion of the usable space within the tent.

However, such locations for internal support structures have several disadvantages, such as limiting functionality or use of the internal space within the tent.

Accordingly, it would be advantageous to provide a tent with internal arch support. It would also be advantageous to provide for the support structure be located outside the typical usable space within the tent. It would be desirable to provide for a tent with internal arch support having one or more of these or other advantageous features. To provide an inexpensive, reliable, and widely adaptable tent with internal arch support that avoids the above-referenced and other problems would represent a significant advance in the art.

SUMMARY

The present invention relates to a tent comprising a shell defining an internal space having a plurality of interface members extending from an inside surface of the shell, at least one internal support structure configured to provide structural support to the shell, and a plurality of support members coupled to the internal support structure and configured to engage the plurality of interface members to couple the at least one internal support structure to the shell. The internal support structure is disposed adjacent and generally parallel to substantially increase useable space within the internal space.

The present invention also relates to an internal support structure for a tent having a shell. The internal support structure comprises a plurality of interface members extending from an inside surface of the shell, at least one internal support structure configured to provide structural support to the shell, a plurality of support members coupled to the internal support structure and configured to engage the plurality of interface members to couple the at least one internal support structure to the shell. The internal support structure is disposed adjacent and generally parallel to substantially increase useable space within the internal space.

The present invention further relates to a tent comprising a shell defining an internal space and a means for providing internal support to the shell without occupying a middle portion of the internal space.

The present invention further relates to various features and combinations of features shown and described in the disclosed embodiments.

Figure 1:
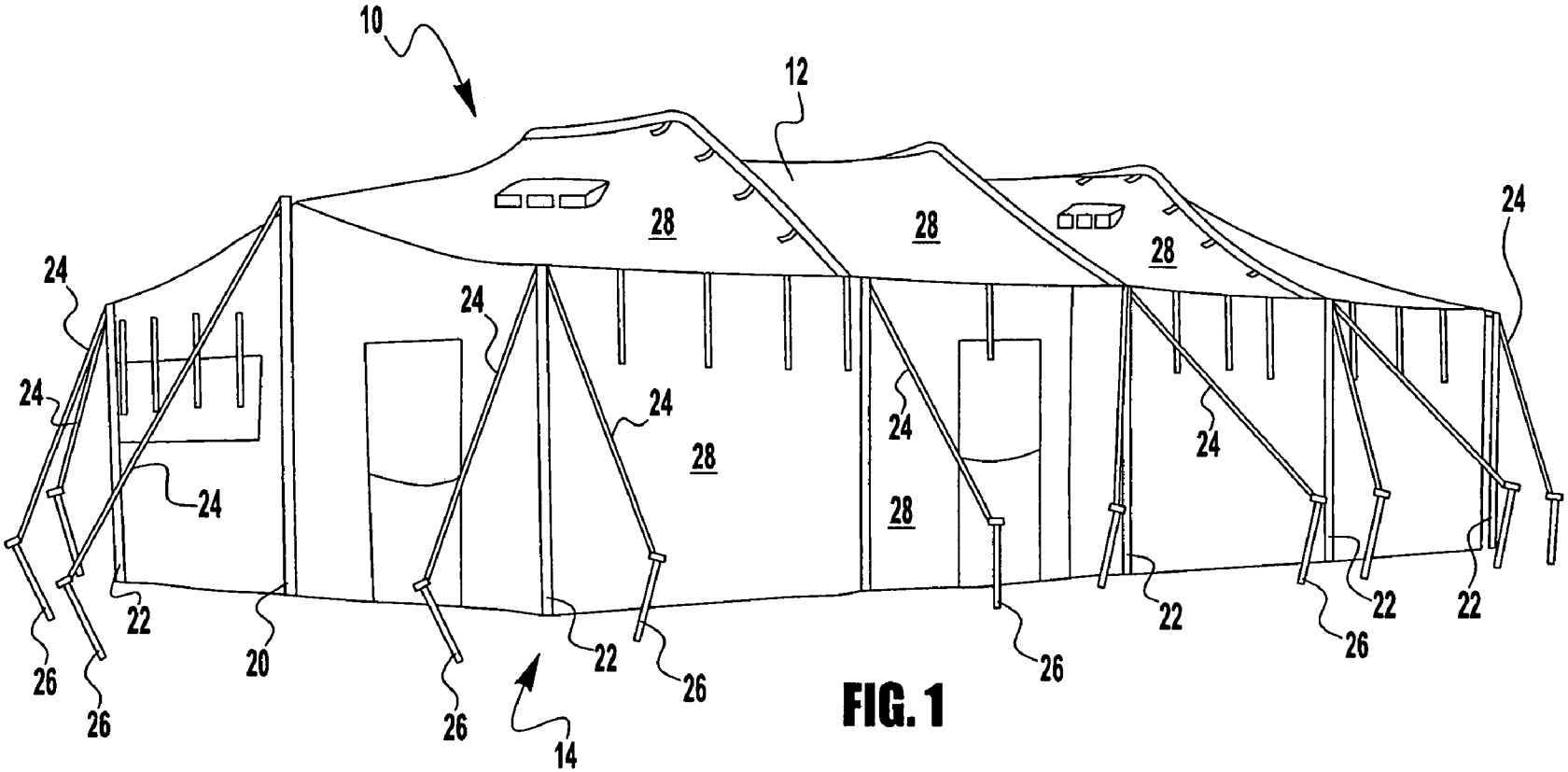
FIG. 1 is an exterior perspective view of a tent with an internal support according to a preferred embodiment.

Before explaining a number preferred, exemplary, and alternative embodiments of the invention in detail it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION OF PREFERRED AND OTHER EXEMPLARY EMBODIMENTS

Before proceeding to the detailed description of the preferred and exemplary embodiments, several comments can be made about the general applicability and the scope thereof.

First, while the components of the disclosed embodiments will be illustrated as an arch support structure designed for use with a tent, the features of the disclosed embodiments have a much wider applicability. For example, the internal support design is adaptable for other tents or shelters, and other recreational, commercial, or military, home, or products which employ a structure configured to support a covering such as a tent. Further, the size of the various components and the size of the containers can be widely varied.

Second, the particular materials used to construct the exemplary embodiments are also illustrative. For example, aluminum is the preferred material for making internal support structure and fittings, but other materials can be used, including other aluminum and/or steel, or thermoplastic resins.

Third, it is important to note that the term "arch," "gusset," and "tent" are intended to be broad terms and not terms of limitation. These components may be used with any of a variety of products or arrangements and are not intended to be limited to use with tent applications.

Figure 2:
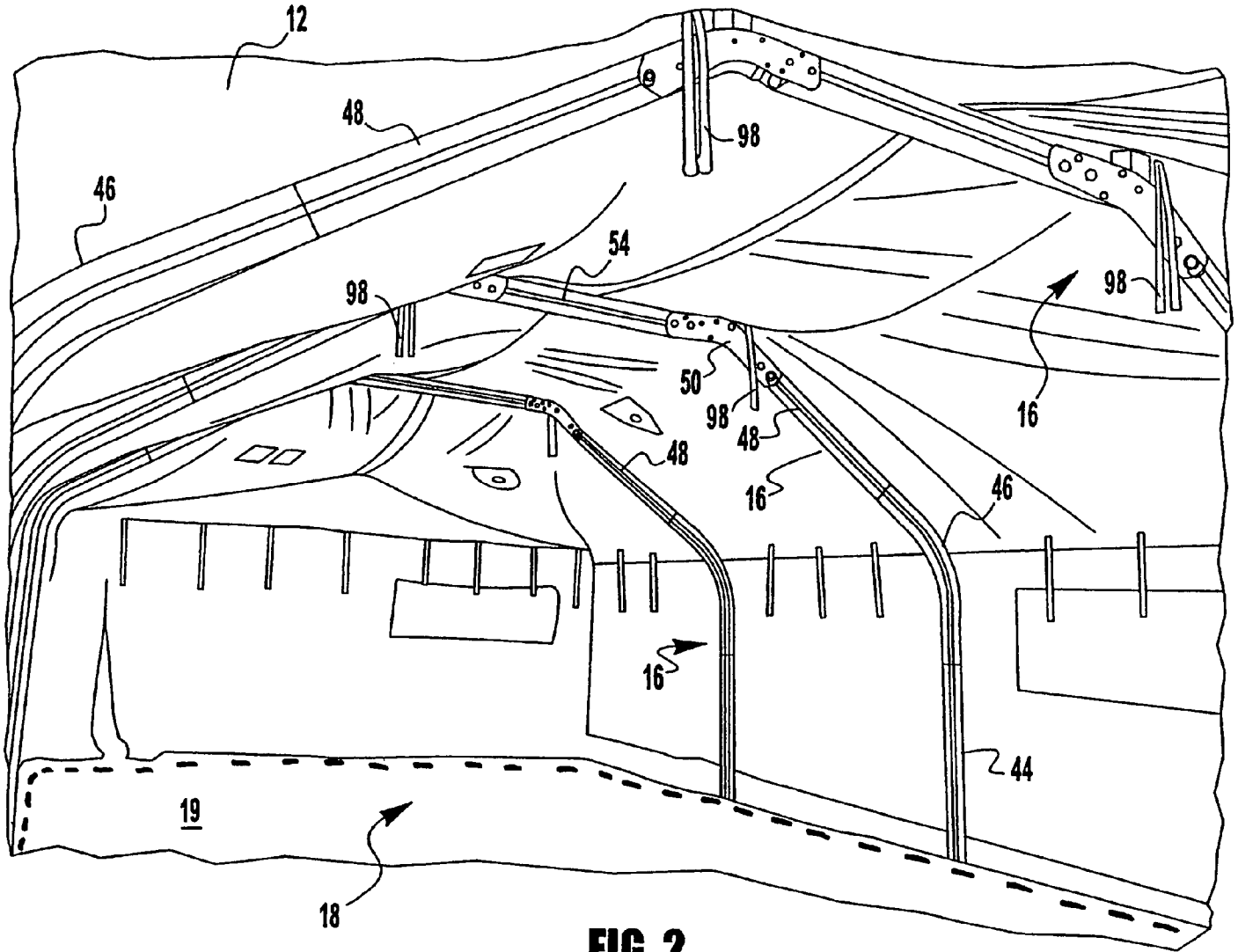
FIG. 2 is an interior perspective view of the tent with the internal support of FIG. 1.
Figure 3:
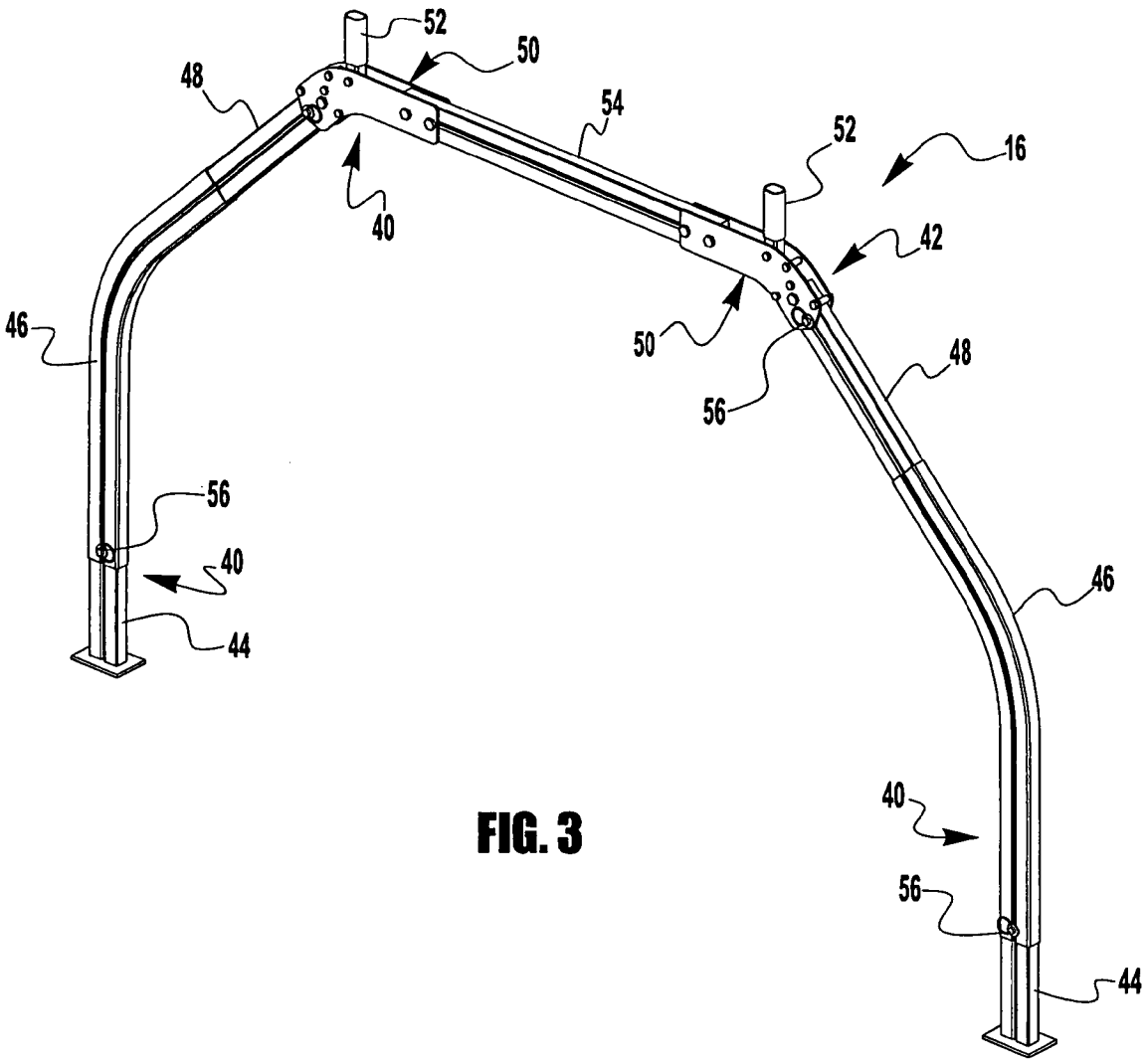
FIG. 3 is a perspective view of the internal support structure according to an exemplary embodiment.
Figure 4:
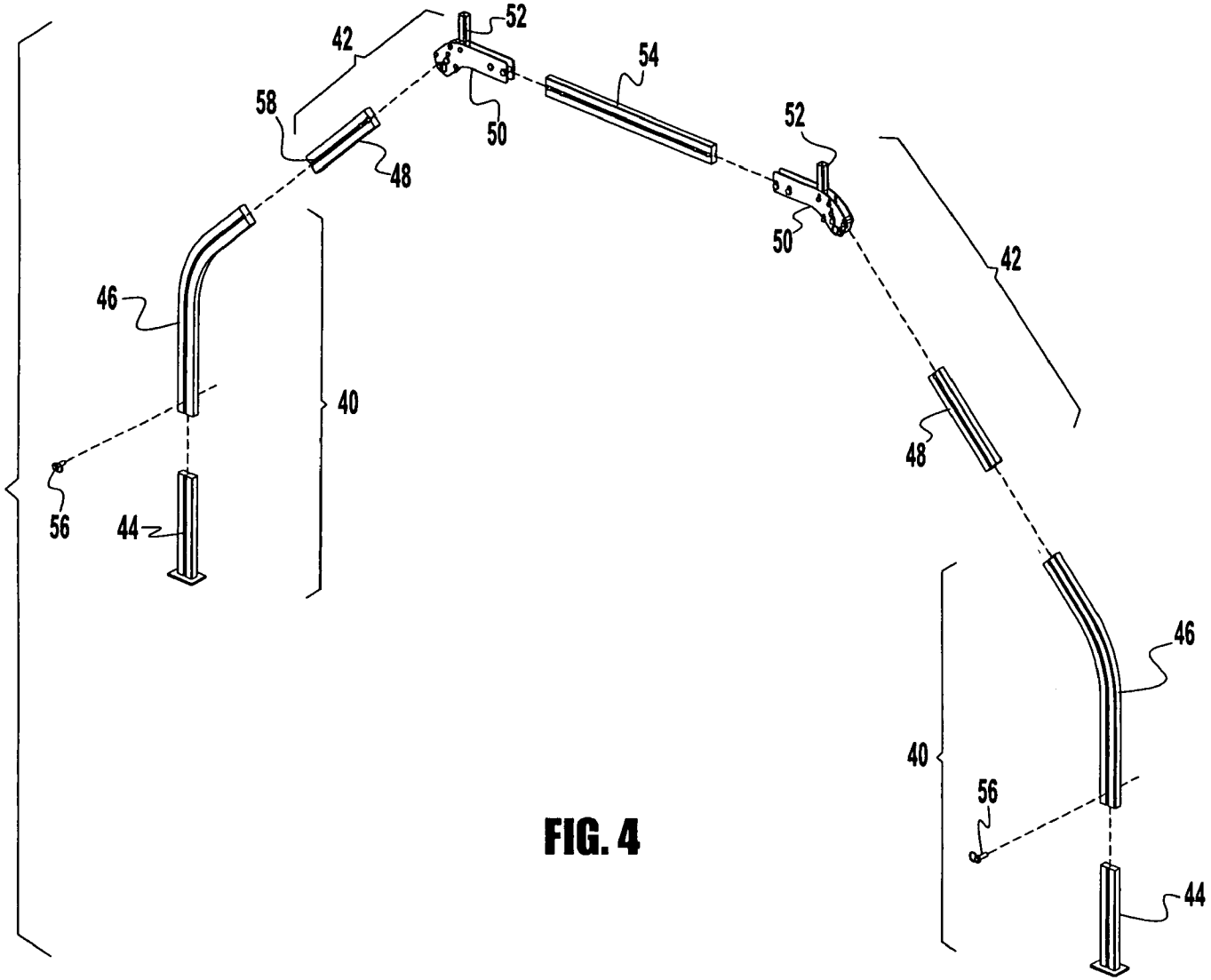
FIG. 4 is an exploded perspective view of the internal support structure of FIG. 3.
Figure 5:
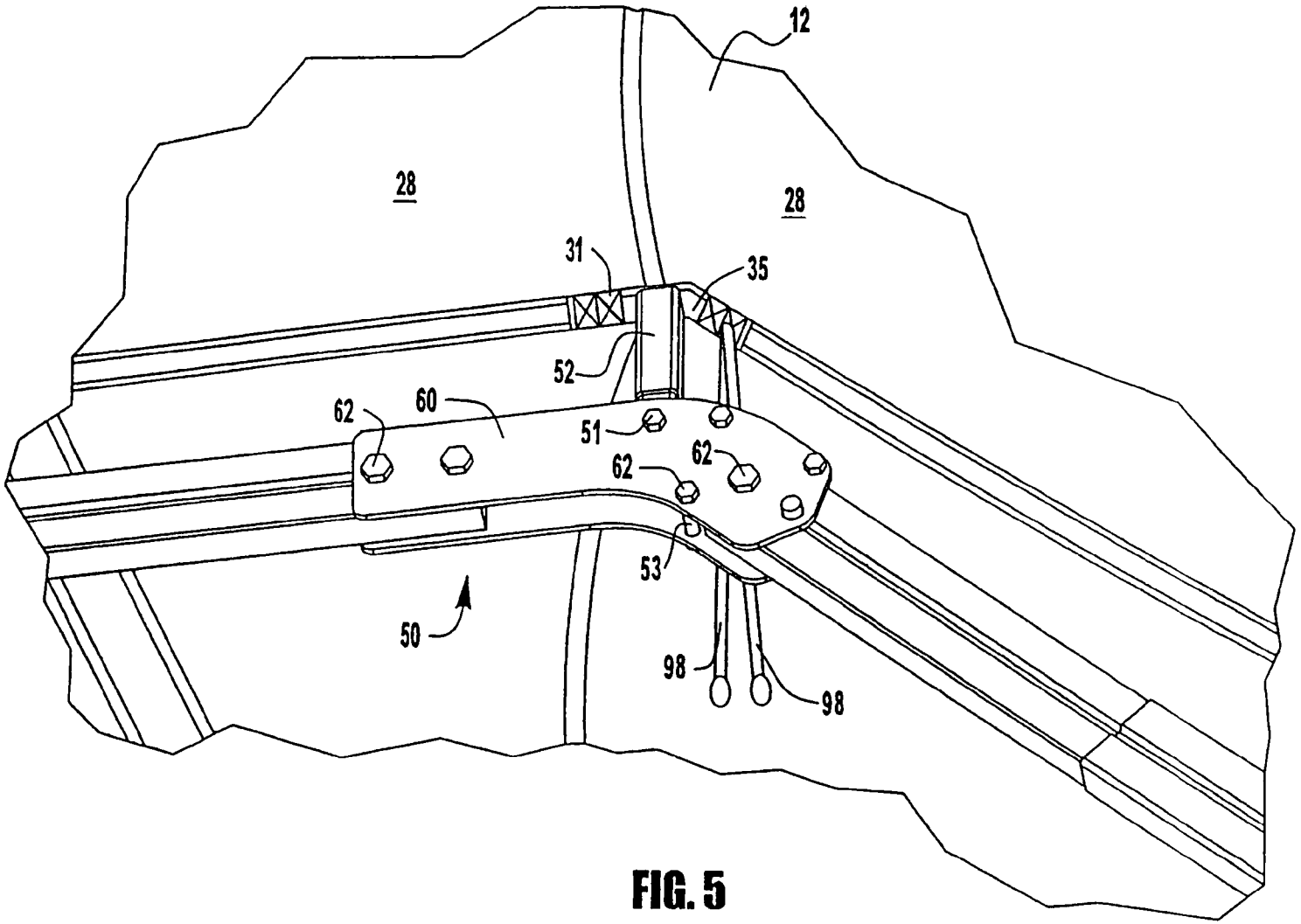
FIG. 5 is a perspective view of a tent support standoff engaged with a fitting extending from the inside of the tent.
Figure 6:
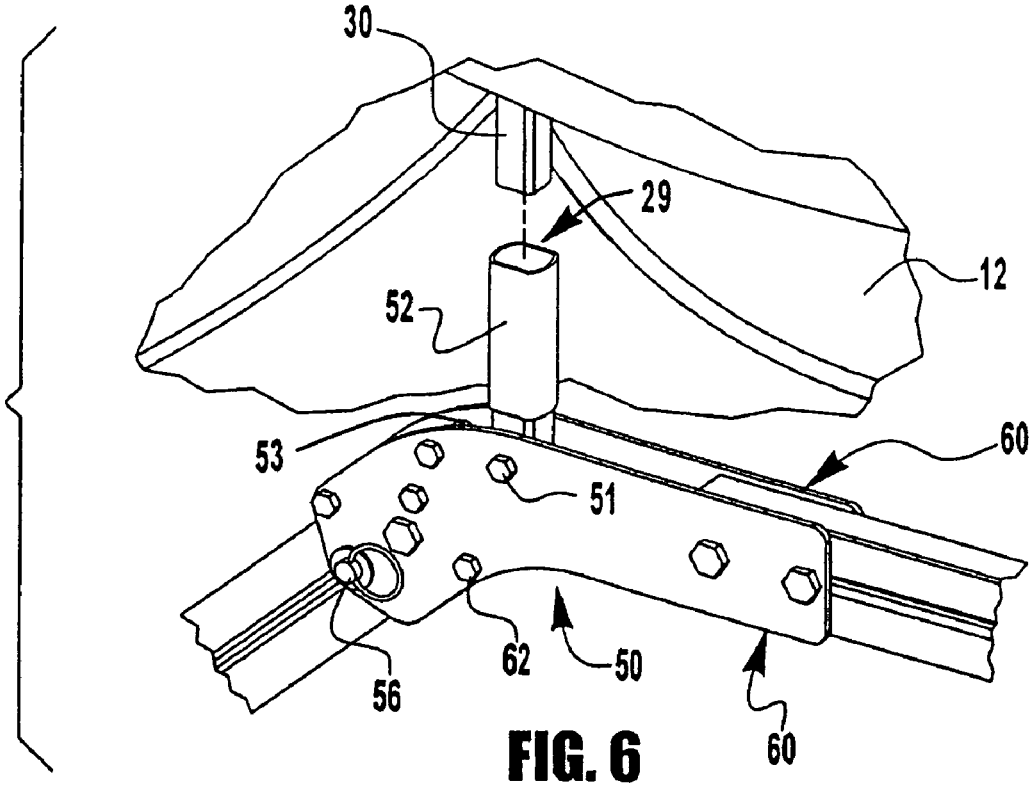
FIG. 6 is an exploded perspective view of the tent support standoff engaged and the fitting of FIG. 5.
Figure 7:
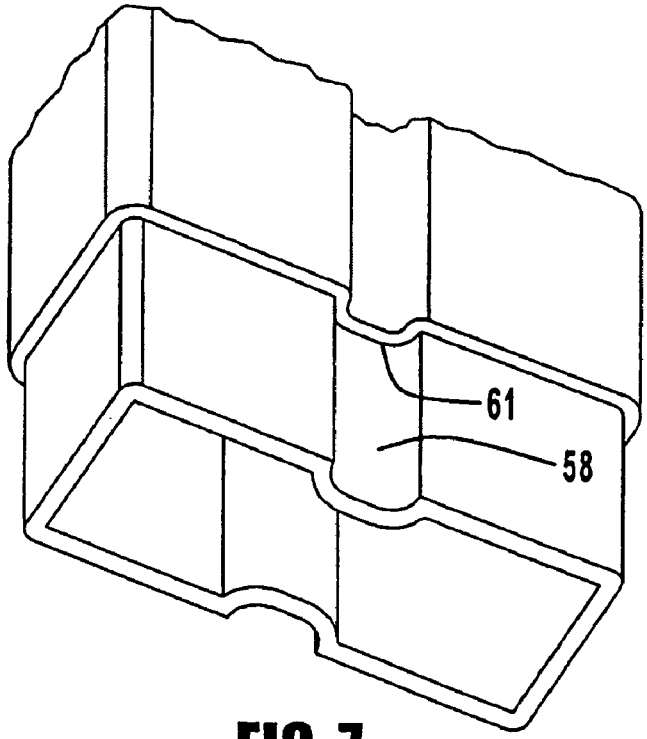
FIG. 7 is a fragmentary view of the engagement of support members.

Proceeding now to descriptions of the preferred and exemplary embodiments, FIGS. 1 and 2 show a tent 10, known as a "tension tent," according to a preferred embodiment. Tent 10 includes a tent covering or shell 12 that is supported by an outer support structure 14 and an inner support structure 16. Shell 12 is preferably made of a flexible material, such as nylon or canvas. Alternatively, the shell may be made from any of a variety of woven or non-woven materials.

Together, shell 12 is supported by outer structure 14 and inner structure 16 to provide an internal space 18. Generally, space 18 is fixed by the size of shell 12 and spacing of the support structures (e.g., the same shell could be configured to provide a small amount of horizontal area (length and width) and have large amount of height (head room); alternatively, the shell could provide a large amount of horizontal area and a small amount of height depending on the intended use and functionality of tent 10; and the like.

The usability or functionality of space 18 is also determined by the placement of inner support structure 16. In conventional tents, the internal support structure is located in or throughout the middle portion (e.g., away from the sides of shell 12) or center of the internal space, thereby reducing the functionality and usability of the tent (i.e., the "open" or "useable" space 19). As used herein, useable space 19 refers to the continuous or uninterrupted area within internal space 18 that is unobstructed by support structures for the tent (e.g., the space between the various support structures for the tent). As shown in FIG. 2, useable space 19 is increased or even maximized by placement of inner support structure 16 adjacent (near or touching) to shell 12 (e.g. defined by broken line in FIG. 2). Conventional internal support structures (such as poles located in the center of space 18 or offset from the sides of shell 12) may prohibit or inhibit using the internal space for large objects (such as furniture, vehicles, etc.), and may reduce the available arrangement or uses of the space (or the adaptability of the space uses).

Outer support structure 14 includes a pair of center and poles 20, a plurality of side poles 22 (five shown on each side), and a plurality of guy wires 24 coupled to the ground by stakes 26. Outer support structure 14 may comprise any of a variety of known arrangements.

Figure 8:
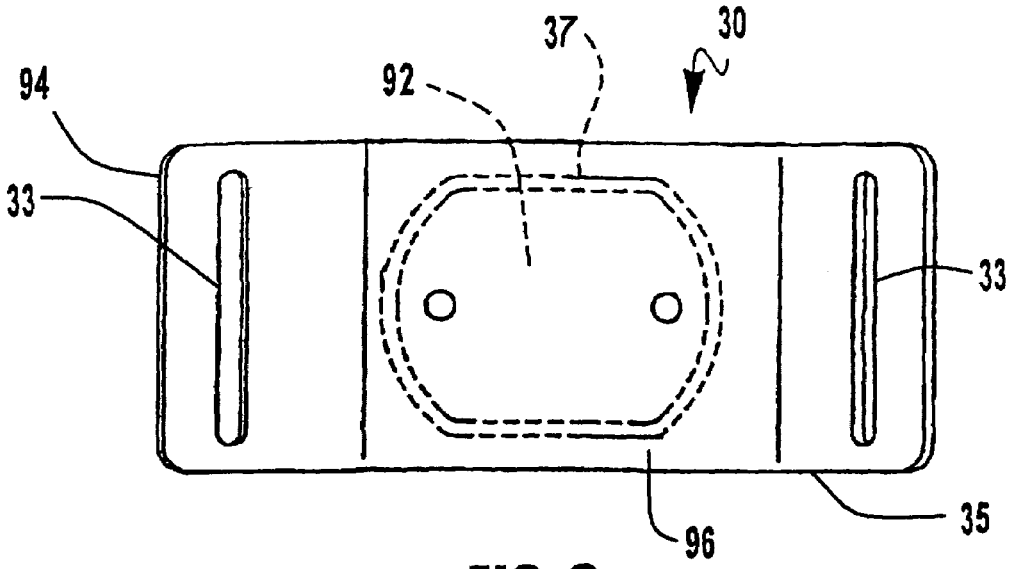
FIG. 8 is a top view of an interface member that is configured to be coupled to the shell of the tent.
Figure 9:
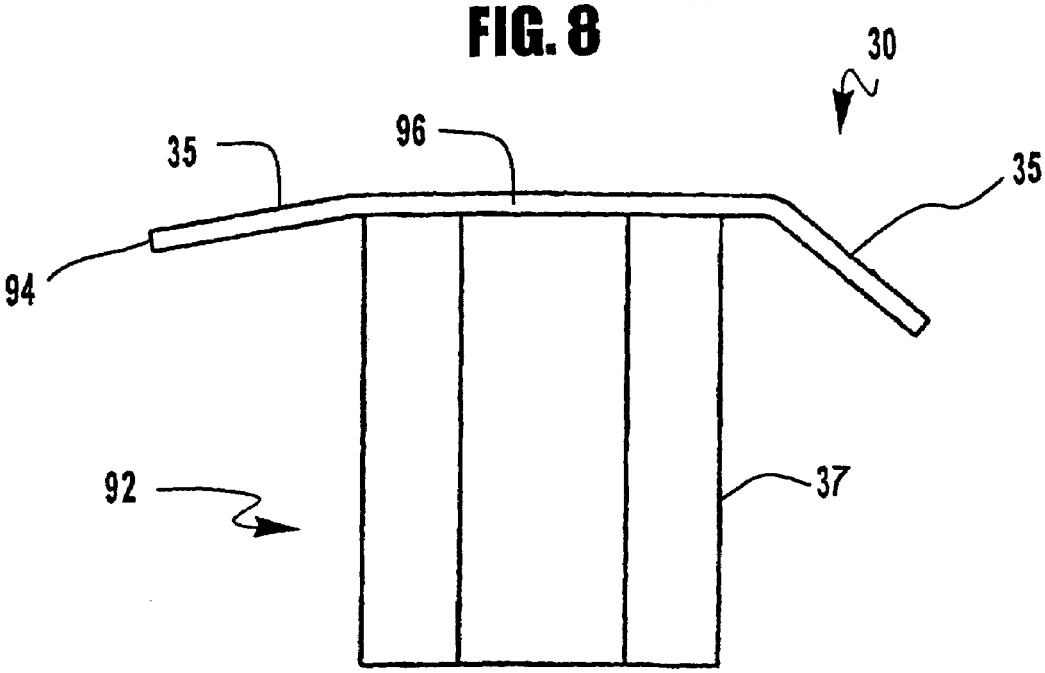
FIG. 9 is a side view of the interface member of FIG. 8.

Shell 12 includes a plurality of panels 28 sewn together and retained by a rope and grommet lace line. Shell 12 also includes a plurality of interface members (shown as fittings 30 in the form of rectangular tubes) coupled to inside of shell 12 and configured to couple to inner support structure 16. Fittings 30 are coupled to shell 12 by webbing or straps 31 that are inserted or threaded through slots 33 on tabs 35 that extend laterally from a central portion 96 of base portion 94 and folded over and sewn or otherwise attached to itself or to shell 12. According to a preferred embodiment, a hollow member (shown as a rectangular tube 37) fits within the support members (also shown with a rectangular tube). In the embodiment illustrated in FIGS. 8 and 9, the rectangular tube 37 forms a double-D profile portion 92 of the fitting 30 that is connected to the central portion 96.

Inner support structure includes a pair of leg sections 40 and an arch section 42. Each leg sections 40 includes a foot or bottom section 44 and a curved member 46. Arch section includes a rafter 48, a gusset 50, a support member (shown as a standoff 52) coupled to gusset 50, and a cross-member or beam 54. According to a preferred embodiment, bottom section 44, curved member 46, and cross-member 54 are hollow or tubular members (shown to have a generally rectangular cross section but may have any of a variety of cross section shapes such as square, circular, elliptical, etc.).

Bottom section 44 is slidably coupled to curved member 46. According to a preferred embodiment, curved member 46 receives bottom section 44 and is retained by a fastener (shown as a quick release pin 56). Pin 56 includes a shaft, a user interface shown as a ring, and a detent (preferably spring loaded, but may be non-spring loaded as well). When curved member 46 and bottom section 44 are positioned relative to each other, pin 56 is inserted in apertures on both curved member 46 and bottom section 44. Curved section 46 and bottom section 44 include complementary structure configured to engage or coact to provide guided movement and positioning (shown as a groove or recess or channel 58 on bottom section 44 and a projection 61 on curved member 46 that engages channel 58).

Rafter 48 is slidably coupled to the top portion of curved member 46. According to a preferred embodiment, curved member 46 receives rafter 48 and is retained by a slip fit engagement and a stop (not shown). Curved section 46 and rafter 48 include complementary structure configured to engage or coact to provide guided movement and positioning (shown as a groove or recess or channel 58 on rafter 48 and a projection 61 on inside curved member 46 that engages channel 58). Alternatively, any of a variety of interfaces or engagements may be used to prevent or inhibit members from twisting or rotating relative to each other (e.g., grooved-ways, curved-flat interfaces, T-interfaces or the like).

The curvature of curved section 46, the positioning of curved section 46 relative to bottom section 44, positioning of rafter 48 relative to curved member 46 and cross member are configured to reflect the configuration of shell 12.

Gusset 50 include a pair of plates 60 coupled together by a plurality of fasteners 62 (shown as bolts). Alternatively, gusset plates 60 may be coupled together by any of a variety of connectors. Gusset plates 60 are also coupled to rafter 48 by a pin 56. At least some of fasteners 62 are configured to limit pivotal movement of rafter about pin 56.

Standoff 52 is coupled to gusset 50 by fasteners (shown as a pivotal attachment to through bolts 51 and spacers 53). At least some of the fasteners 62 are configured to limit pivotal movement of the standoff 52 about the bolt 51 and spacer 53. Standoff 52 includes a hollow or tubular member (shown to have a generally rectangular cross section but may have any of a variety of cross section shapes such as square, circular, elliptical, etc.). Standoff 52 includes a receptacle 29 (e.g., space defined by the hollow member) configured (e.g., shaped) to receive fitting 30 extending or projecting from inside of shell 12. Engagement of fitting 30 and standoff 52 is configured to provide structural support to shell 12. A fastener 98 may be used to further couple the fitting and the standoff, i.e. as a means to prevent disengagement of the fittings 30 from the standoff 52.

According to an exemplary embodiment, the tent comprises a shell defining an internal space having a plurality of interface members extending from an inside surface of the shell; at least one internal support structure configured to provide structural support to the shell; and a plurality of support members coupled to the internal support structure and configured to engage the plurality of interface members to couple the at least one internal support structure to the shell. The internal support structure is disposed adjacent and generally parallel to substantially increase useable space within the internal space. The internal support may be configured to maximize the useable space within the internal space. The shell may be supported without the use of poles located in the middle area of the internal space. The shell may be supported by the engagement of the support members and the interface members, and by being draped across at least a portion of the at least one internal support structure. Each of the interface members preferably comprise a receptacle configured to receive one of the interface members. Preferably, the internal support structure is an arch. In one embodiment, the interface members and/or the support members are rectangular tube shaped members. Alternatively, they may be any of a variety of shapes. In one embodiment, the interface members each include a pair of tabs having slots configured to receive straps sewn to the shell. Engagement of the support member and the interface member is preferably configured to provide a space between the shell and means for providing internal support. The support member is preferably configured to receive the interface member in a sliding engagement (e.g., an inside dimension of the first rectangular tube is larger than an external dimension of the second rectangular tube).

It is also important to note that the construction and arrangement of the elements of the tent with internal arch support as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the members, fittings, and standoffs may have any of a variety of shapes, sizes, and/or configurations. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A tension tent, comprising:

a shell defining an internal space defined by side walls and a roof;

a plurality of fittings coupled to an inside surface of the roof;

an inner support structure positioned inside of the shell, the inner support structure including a plurality of arch support structures, each arch support structure including at least two gussets, each gusset including a support member attached thereto and configured to couple to one of the plurality of fittings to provide support to the shell; and an outer support structure positioned outside of the shell, the outer support structure including a plurality of poles attached to an exterior of the shell and a plurality of guy wires and stakes.

2. The tension tent of claim 1, wherein the support members are configured to provide an engagement with the fittings such that a space between the interior surface of the roof of the shell and the inner support structure results.

3. The tension tent of claim 1, wherein the fittings comprise a double-D profile portion and a base portion, the base portion including at least one slot therethrough, and wherein the fittings are coupled to the inside surface of the roof by at least one strap threaded through the at least one slot.

4. The tension tent of claim 3, wherein the base portion includes central portion connected to the double-D profile portion, a first tab and a second tab extending laterally from the central portion, and wherein the first tab and the second tab are in an angled relationship to the central portion to form a peak of the roof.

5. The tension tent of claim 1, wherein each of the support members comprise a standoff portion pivotally attached to the gusset and a receptacle portion configured to receive the fitting therein.

6. The tension tent of claim 5, wherein the standoff is hollow, and wherein the receptacle portion comprises a space defined by the hollow standoff.

7. The tension tent of claim 1, further comprising means for preventing disengagement of the fittings from the support members.

8. The tension tent of claim 7, wherein the means for preventing disengagement of the fittings from the support members comprises a fastener affixed to the roof in proximity to the fitting.

9. The tension tent of claim 1, wherein the plurality of arch support structures are coupled only to the shell through the plurality of fittings.

10. The tension tent of claim 1, wherein the plurality of arch support structures comprise a pair of leg sections and an arch section.

11. The tension tent of claim 10, wherein each leg section comprises a foot section and a curved member.

12. The tension tent of claim 10, wherein the arch section comprises a pair of rafters, the at least two gussets, and at least one cross member, the gusset providing an angular coupling between the rafter and the cross member.

13. The tension tent of claim 1, wherein the gusset comprises two plates coupled together in a spaced relationship by a plurality of connectors.

14. The tension tent of claim 13, wherein the plates are coupled to the support member by at least one of the connectors, and wherein at least one of the plurality of connectors is positioned to limit pivotal movement of the support member.

15. The tension tent of claim 1, wherein the side walls are generally vertical, and wherein the roof comprises angled portions coupled to the side walls and a generally horizontal portion located between opposite angled portions of the roof, and wherein the plurality of arch support structures comprise a pair of leg sections located in close proximity to the generally vertical side walls, and an arch section including a pair of rafters positioned in proximity to the angled portions of the roof and at least one cross member positioned in proximity to the generally horizontal portion of the roof.

16. The tension tent of claim 15, wherein the at least two gussets are coupled between the cross member and the two rafters and wherein the fittings are coupled to the roof at a point between the angled portions and the generally horizontal portion.

17. The tension tent of claim 15, wherein the leg sections each include a vertical foot section configured to extend along a portion of the vertical side wall, and a curved member configured to be coupled to the foot section and to extend along a portion of the vertical side wall and along a portion of the angled portion of the roof.

18. The tension tent of claim 1, wherein the internal space if further defined by front and back walls, and wherein the plurality of poles includes a center pole positioned to support the front wall at a central point between opposing side walls.

19. An inner arch support structure for a tension tent having a shell defining an internal space defined by side walls and a roof, and including a plurality of fittings coupled to an inside surface of the roof, comprising:

a pair of leg sections, each leg sections having a vertical foot section removably coupled to a curved member; and an arch section including a pair of rafters removably coupled to each of the curved members of the pair of leg sections, a pair of gussets pivotally attached to the pair of rafters, at least one horizontal cross member coupled on either end to one of the pair of gussets, and a support member pivotally attached to each of the gussets, each of the support members being configured to couple to one of the plurality of fittings.

20. The inner arch support structure of claim 19, wherein the gusset comprises two plates coupled together in a spaced relationship by a plurality of connectors.

21. The inner arch support structure of claim 20, wherein the plates are coupled to the support member by at least one of the connectors, and wherein at least one of the plurality of connectors is positioned to limit pivotal movement of the support member.

22. The inner arch support structure of claim 19, wherein each of the support members comprise a standoff portion pivotally attached to the gusset and a receptacle portion configured to receive the fitting therein.

23. The inner arch support structure of claim 22, wherein the standoff portion is hollow, and wherein the receptacle portion comprises a space defined by the hollow standoff.

24. The inner arch support structure of claim 19, wherein each of the curved member and the foot section include complementary structure configured to coact to provide guided movement and positioning therebetween.

25. The inner arch support structure of claim 24, wherein the complementary structure includes a channel on one of the curved member and the foot section and a projection of the other of the curved member and the foot section.

26. The inner arch support structure of claim 19, wherein each of the curved member and the rafter include complementary structure configured to coact to provide guided movement therebetween and to inhibit rotation relative to each other.

* * * * *